United States Patent [19]

Kvamsdal

[11] 4,382,524

[45] May 10, 1983

[54] SPHERICAL TANK SUPPORTED BY A VERTICAL SKIRT

[75] Inventor: Rolf Kvamsdal, Moss, Norway

[73] Assignee: Moss Rosenberg Verft A/S, Moss, Norway

[21] Appl. No.: 53,307

[22] Filed: Jun. 29, 1979

Related U.S. Application Data

[63] Continuation of Ser. No. 843,257, Oct. 18, 1977, abandoned.

[30] Foreign Application Priority Data

Oct. 21, 1976 [NO] Norway ..... 763591

[51] Int. Cl.[3] ..... B65D 90/04

[52] U.S. Cl. ..... 220/445; 220/18; 114/74 A

[58] Field of Search ..... 220/9 B, 9 LG, 1 B, 220/426, 18, 445; 114/74 A, 74 R, 74 T; 62/45

[56] References Cited

U.S. PATENT DOCUMENTS

| | | | |
|---|---|---|---|
| 1,235,128 | 7/1917 | Frank | 220/445 |
| 2,315,453 | 3/1943 | Pittman | 220/18 |
| 2,690,273 | 9/1954 | Arne | 220/1 T |
| 2,955,723 | 10/1960 | McGrath | 220/20.5 |
| 3,841,269 | 10/1974 | Urruela | 220/445 |
| 3,968,764 | 7/1976 | Kvamsdal et al. | 220/445 |

*Primary Examiner*—Joseph Man-Fu Moy

*Attorney, Agent, or Firm*—Harold L. Stults; Pasquale A. Razzano

[57] ABSTRACT

A spherical tank is supported by a vertical skirt extending from the tank equator down to a foundation. An enclosed space defined by the spherical tank, the skirt and the foundation is made pressure tight and is connected to a pressure-regulating system, thus permitting regulation of the pressure within the space.

1 Claim, 1 Drawing Figure

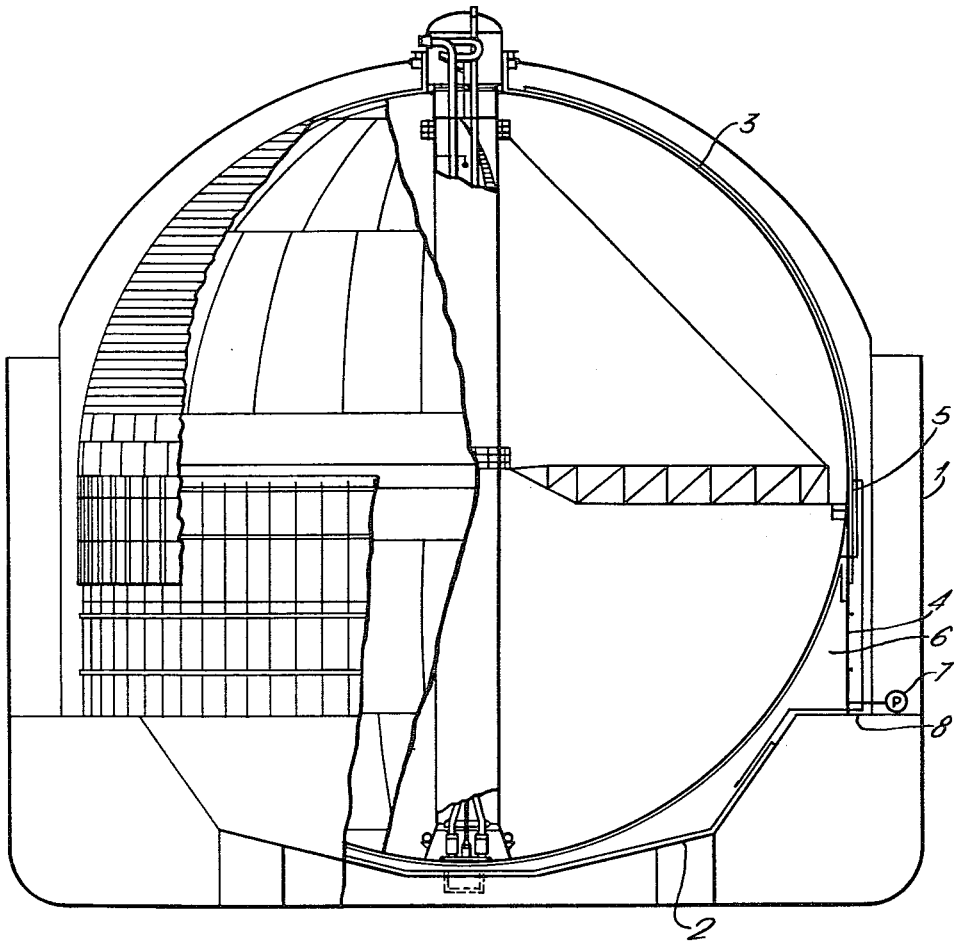
3
5
3
4
6
7
8
2

SPHERICAL TANK SUPPORTED BY A VERTICAL SKIRT

This is a continuation of application Ser. No. 843,257, filed Oct. 18, 1977, now abandoned.

The invention relates to an improvement on a spherical tank which is supported by a vertical skirt that extends from the tank equator down to a foundation. Spherical tanks of this type, with their associated skirt supports, are frequently used on board ships that transport LNG and LPG. In practice, such spherical tank constructions, known as Moss-Rosenberg spherical tank systems, have proved very practical, one of their advantages being that they are simple.

With such tank systems it is known that the greatest amount of loading is in the equator region, which is subjected to high static loads, i.e., the weight of the tank and its contents. Recent developments in the tanker field, owing both to market conditions and to other factors, have led to the desire to extend the area of application for such spherical tank constructions to ships which carry heavier cargo, such as propane, butane and other petroleum products. Loading in the equator region and, partly, in the skirt, which is subjected to buckling stresses, has in several instances made it necessary to impose a partial cargo limit, for example, filling the tanks to the 80% fill level. With a view toward avoiding this limitation, then, it is the object of the invention to provide a way to reduce the load component which is due to the weight of the cargo and the tank. This is achieved by placing the enclosed space between bottom hemisphere of the spherical tank, the skirt and the double bottom of the ship under an air pressure. In this way, the air in that space provides support which directly reduces the load component owing to the weight of the tank and cargo. Other load or force components will also increase, e.g., such as the loading in the ring direction (the horizontal plane), but the importance of that is negligible.

In this embodiment of the invention air pressure normally will be moderate, of the order of 0.2 kp/cm$^2$, and it will be limited by the range of buckling stresses which the lower hemisphere of the tank shell can withstand when the tank is partially filled or empty, as well as by the strength of the double bottom of the ship.

It may sometimes be desirable to place this space under a partial vacuum, thus enabling the lower hemisphere to withstand higher buckling stresses in cases where part-capacity cargoes in the region of 5% and up to 50–60% fill level are being carried.

The invention has been discussed above as it relates to spherical tanks on board ship, as this is perhaps the most relevant area of application at present, but this should not be interpreted as limiting the area of application for the invention, which can be used on skirt-supported spherical tanks in general.

According to the invention, therefore, an improvement is provided in a spherical tank which is supported by a vertical skirt extending from the tank equator down to a foundation, the improvement according to the invention being characterized in that the enclosed space defined by the spherical tank in combination with the skirt and the foundation is made pressure tight and is connected to a pressure-regulating system, thus permitting regulation of the pressure within the space.

The invention will be further explained with reference to the drawing, which shows a schematic cross section of a ship having a skirt-supported spherical tank.

On the drawing, the ship is designated 1 and its double bottom 2. The spherical tank 3 is supported on the double bottom 2 of the ship by means of a vertical skirt 4 which extends from the equator region 5 of the tank down to the double bottom 2. The space 6 between the lower hemisphere, the skirt and the double bottom is pressure tight and can thus be placed under increased or diminished air relative to the atmospheric pressure. For this purpose, a pump 7 with a connecting line 8 into the space 6 is indicated. Other necessary equipment, such as safety valves, etc., is not shown, as the components used are of known types and the pressure regulation is thus carried out by techniques that are known per se.

If the space 6 is subjected to an elevated air pressure, the loading component on the skirt that is due to the weight of the cargo and the spherical tank will be directly reduced. As mentioned previously, this will means that there would be an increase in other load components, such as the loading in the ring direction (the horizontal plane), but such increases would be of negligible importance. The air pressure used, which is moderate, on the order of up to Q,2 kp/cm$^2$, is limited by the amount of buckling stress that the lower hemisphere of the tank shell could withstand, as well as by the strength of the double bottom.

As discussed previously, the space 6 can also be put under a partial vacuum, which is particularly advantageous when carrying partial-capacity cargo in the order of 5% and up to 50–60% fill level, because the lower half-sphere can thereby be adapted to withstand higher buckling stresses.

Having described my invention, I claim:

1. Means for storing liquefied gas, such as LNG or LPG or heavier petroleum products comprising, the combination of, a spherical tank, a marine vessel having a bottom hull structure surrounding the bottom hemisphere of said tank, a skirt which has an upper edge substantially at the horizontal equator of said tank and which extends downwardly therefrom and is attached to said hull structure, said skirt and said hull structure providing the sole support for said tank and forming therewith a fluid-tight enclosed space surrounding substantially the entire bottom surface of said lower hemisphere of said tank, and a pressure-regulating system which is operative to regulate the pressure within said enclosed space and is adapted to produce a partial-vacuum condition in said space to enable said tank to withstand buckling stresses when the cargo in said tank is of the order of 5% to 60% of the full capacity of said tank, said pressure-regulating system also being operative to increase the pressure in said enclosed space to exert upward pressure on said lower hemisphere of said tank to aid in supporting said lower hemisphere of said tank and the cargo to thereby reduce the load component on said skirt which is due to the weight of said tank and the cargo in said tank when the amount of said cargo makes it desirable to do so to thereby permit said tank to be filled with heavier cargo.

* * * * *